US012006128B2

(12) United States Patent
Hennemann et al.

(10) Patent No.: US 12,006,128 B2
(45) Date of Patent: Jun. 11, 2024

(54) DEVICE FOR CLOSING A CONTAINER OF A LIQUID TO PASTY PRODUCT AND REFILL CLOSED BY SUCH A DEVICE

(71) Applicant: PROMENS SA, Bellignat (FR)

(72) Inventors: Pascal Hennemann, Vaux-les-Saint-Claude (FR); Joey Kurtz, Wasselonne (FR)

(73) Assignee: PROMENS SA, Bellignat (FR)

( * ) Notice: Subject to any disclaimer, the term of this patent is extended or adjusted under 35 U.S.C. 154(b) by 178 days.

(21) Appl. No.: 17/624,226

(22) PCT Filed: Jul. 2, 2020

(86) PCT No.: PCT/EP2020/068653
§ 371 (c)(1),
(2) Date: Dec. 30, 2021

(87) PCT Pub. No.: WO2021/013492
PCT Pub. Date: Jan. 28, 2021

(65) Prior Publication Data

US 2022/0348396 A1 Nov. 3, 2022

(30) Foreign Application Priority Data

Jul. 19, 2019 (FR) ..... 1908253

(51) Int. Cl.
*B65D 83/00* (2006.01)
*B65D 33/16* (2006.01)

(52) U.S. Cl.
CPC ..... *B65D 83/0072* (2013.01); *B65D 33/16* (2013.01); *B65D 83/005* (2013.01); *B65D 2583/005* (2013.01)

(58) Field of Classification Search
CPC .. B65D 83/0072; B65D 83/005; B65D 33/16; B65D 2583/005
(Continued)

(56) References Cited

U.S. PATENT DOCUMENTS 5,292,033 A * 3/1994 Gueret ..... B05B 11/028 222/105
7,028,865 B2 * 4/2006 Heukamp ..... B05B 11/1028 222/257
(Continued)

FOREIGN PATENT DOCUMENTS

DE 102016106636 A1 10/2017
EP 2095882 A1 9/2009
(Continued)

OTHER PUBLICATIONS

Foreign Communication from a Related Counterpart Application, International Search Report dated Oct. 21, 2020, International Application No. PCT/EP2020/068653 filed on Jul. 2, 2020.
(Continued)

*Primary Examiner* — Donnell A Long

(57) ABSTRACT

The invention relates to a closure device comprising a closure wall having a communication conduit passing through it and intended to close the opening of a container of a product and a stopper movable in the duct. The stopper comprises a cavity open on one side of the wall, closed by a bottom and comprising at least one lateral opening. In the closed position, this bottom closes the conduit, and in the open position, the side opening(s) and said bottom exit the conduit, the conduit thus being open in fluid communication through the stopper. The invention also relates to a product refill comprising a container closed by this closure device. It also relates to a dispensing device comprising this refill and a dispensing head.

20 Claims, 7 Drawing Sheets

(58) Field of Classification Search
USPC ..... 222/325, 321.1, 321.2, 321.7–321.9
See application file for complete search history.

(56) References Cited

U.S. PATENT DOCUMENTS

| | | | | |
|---|---|---|---|---|
| 7,500,582 | B2 * | 3/2009 | Pritchett | B05B 11/0075 222/321.7 |
| 11,745,200 | B2 * | 9/2023 | Goettke | B05B 11/028 222/321.7 |
| 2001/0025863 | A1 * | 10/2001 | Lorscheidt | B05B 11/026 222/321.9 |
| 2010/0163646 | A1 | 7/2010 | Havlovitz et al. | |
| 2011/0240677 | A1 * | 10/2011 | Dwyer | B05B 11/028 222/321.2 |
| 2014/0103068 | A1 * | 4/2014 | Son | B65D 3/04 222/105 |
| 2015/0102064 | A1 * | 4/2015 | Taberlet | B05B 11/1054 222/153.05 |
| 2020/0023391 | A1 * | 1/2020 | Cesare | B65D 75/5883 |

FOREIGN PATENT DOCUMENTS

| | | | |
|---|---|---|---|
| LU | 88593 | A1 | 9/1995 |
| WO | 2009136877 | A1 | 11/2009 |
| WO | 2015107305 | A1 | 7/2015 |
| WO | 2016210217 | A1 | 12/2016 |
| WO | 2021013492 | A1 | 1/2021 |

OTHER PUBLICATIONS

Foreign Communication from a Related Counterpart Application, Written Opinion dated Oct. 21, 2020, International Application No. PCT/EP2020/068653 filed on Jul. 2, 2020.

* cited by examiner

[Fig. 7]
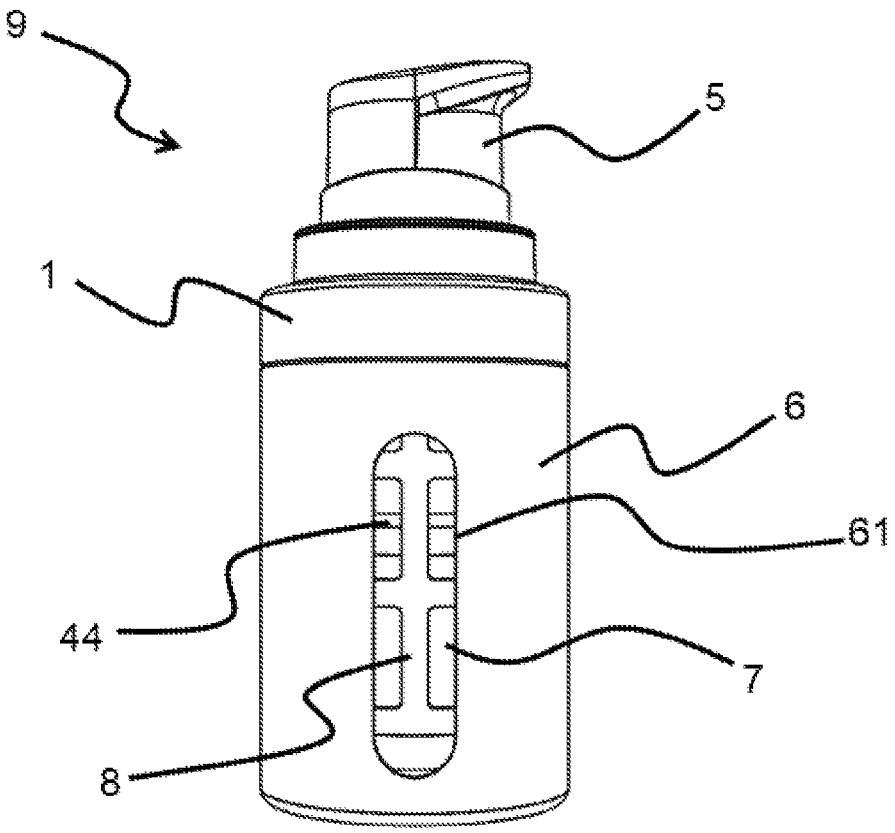

DEVICE FOR CLOSING A CONTAINER OF A LIQUID TO PASTY PRODUCT AND REFILL CLOSED BY SUCH A DEVICE

CROSS-REFERENCE TO RELATED APPLICATIONS

The present application is a filing under 35 U.S.C. 371 as the National Stage of International Application No. PCT/EP2020/068653, filed Jul. 2, 2020, entitled "DEVICE FOR CAPPING A CONTAINER OF A LIQUID TO PASTY PRODUCT AND REFILL CLOSED BY SUCH A DEVICE," which claims priority to French Application No. 1908253 filed with the Intellectual Property Office of France on Jul. 19, 2019, both of which are incorporated herein by reference in their entirety for all purposes.

The present invention relates to the field of airless dispensing devices (also called "Airless" devices) for a liquid to pasty product, in particular a cream, an ointment, or a paste, especially for cosmetic use.

More particularly, the present invention relates to a closure device for closing a container of such a product, comprising a stopper enabling the closure device and thus the container to be sealed in an airtight manner, the stopper being capable of being displaced so as to provide access to the interior of the container. In particular, this displacement may be implemented when mounting a product dispensing head on the container sealed by this closure device. In an improved embodiment, the closure device is arranged to allow attachment with three elements at a time to the same closure device, at least one of these elements being reversibly mounted and at least one of these elements being irreversibly mounted.

In particular, these three elements may be a manual pump, in particular without air intake, a container, in particular without air intake and of variable and/or deformable volume, and a receptacle or shell in which the container is accommodated. In such a case, at least the package is irreversibly mounted on the closure device, and at least the receptacle is reversibly mounted on the closure device.

By reversible assembly is meant in the present application an assembly which can be disassembled in the same way as it was assembled, without breaking any parts, in particular with the same tool as during assembly or without any tool, preferably with the same energy.

It is known in the state of the art of dispensing devices with a dispensing head fixed on the neck of a container or receptacle, containing a liquid or a cream. These heads can include manual pumps that suck the product into the container and then pump it out. The receptacle and the dispensing head are usually irreversibly fixed. As a result, when the dispensing device is empty, it is thrown away. This represents a certain amount of plastic.

Today, in order to save material and reduce plastic waste, more sustainable solutions are being sought.

Solutions using refills have been developed but often the dispensing devices and their refills are complex structures to realize.

An aim of the present invention is therefore to find a dispensing device of which at least some parts can be reused, while remaining simple in design.

For this purpose, a first object of the invention relates to a closure device for sealing a container of a liquid to pasty product, said closure device comprising:

a closure base comprising a closure wall having a through communication conduit, said closure wall being intended to close the opening of a container of a liquid to pasty product, a stopper movable in the communication channel between a closed position and an open position, wherein the stopper comprises a bottom and a cavity open on one side of the closure wall and closed by said bottom, the cavity comprising at least one lateral opening, the stopper being arranged with the communication conduit in such a way that in the closed position, said bottom sealingly closes the communication conduit, and in the open position, the stopper is partially out of the communication conduit, said lateral opening(s) and said bottom being out of the communication conduit, so that the communication conduit is open in fluid communication through the stopper.

Thus, an opening of a product container, e.g. a product refill, can be closed by covering it with the closure wall, e.g. in airtight contact with the neck of the container. With the stopper in the closed position and by attaching the closure device to the container so as to maintain this sealing contact, a tightly closed container is thus obtained.

When mounting a dispensing head, the stopper can then be moved partially out of the conduit into the open position, thereby providing communication between the dispensing head and the container through the stopper. The communication through the stopper is between the side opening(s) and the opening through which said cavity opens on one side of the closure wall. With a container having a variable and/or deformable volume, and a dispensing head without air intake, in particular a manual pump without air intake, mounted in a sealed manner on this closure device, this displacement of the stopper into the open position is carried out in an "Airless" manner, i.e. without air intake, and therefore without bringing the product into contact with the outside air.

The stopper thus forms a hermetic closure for the container, while allowing easy opening of the stopper when mounting the dispensing head. This simplifies use, which is particularly useful for refills.

In addition, the stopper forms a closure indicator, which is particularly useful in the case of refills displayed on a shelf, without a dispensing head, or in the case of delivery of a refill closed in this way by a subcontractor to a dispensing device manufacturer.

On the other hand, the closure device is very simple in design, since a simple wall with a through duct and a stopper with a lateral opening, for example in the form of a cup with a lateral opening, are sufficient to produce a tight closure that can be opened when the container, for example the refill, is assembled.

The closure device according to the invention may optionally have one or more of the following features taken separately or in combination:

the communication conduit communicates between a first surface and a second surface of the closure wall, said closure wall being intended to close the opening of the container of a liquid to pasty product with the first surface facing the interior of the container, so that in the closed position, said lateral opening(s) and said bottom are in the communication conduit and in the open position, said lateral opening(s) and said bottom are outside the communication conduit on the side of said first surface; thus the stopper can be driven from the closed position to the open position by simply pushing it in, for example when mounting a dispensing head on the side of the second surface;

the communication conduit and/or the stopper comprise at least one deformable member, arranged so as to retain the stopper in the closed position up to a certain threshold of thrust exerted on the stopper towards the open position; this makes the closure more secure; it also reinforces the role of opening indicator in the case of refills;

the communication conduit and/or the stopper comprise a member for blocking the stopper in the open position; this reduces the risk of the stopper being dislodged from the communication conduit;

the said deformable member and/or the said blocking member are arranged on and/or are in engagement with the internal wall of the communication conduit; this makes it possible to implement the closure device very simply;

the closure wall has a first surface and a second surface opposite this first surface, and comprises an irreversible fixing interface which is:

intended to be fixed to the neck of a container of a liquid to pasty product, arranged on the side of said first surface, and arranged around a zone where the communication conduit opens onto this said first surface;

the product container is thus irreversibly mounted on the closure wall; in the context of a refill, it is ensured that the latter has not been opened; for example, the irreversible fixing interface comprises at least one irreversible clip, in particular an annular clip; the irreversible clip(s) is (are) a mounting system that is impossible for a user to separate;

the closure wall has a first surface and a second surface opposite this first surface, and the closure base comprises a reversible or irreversible mounting interface that is:

intended to be mounted on a dispensing head, arranged on the side of said second surface, and arranged around an area where the communication conduit opens onto said second surface;

a functionality is thus added to the closure device, thus facilitating its assembly;

the closure wall has a first surface and a second surface opposite that first surface, the first surface being intended to face the interior of the container, and the closure base comprises a reversible mounting interface which is:

intended to be mounted to the neck of a receptacle, arranged on one side of said first surface, and arranged around the mounting interface;

whereby the receptacle can be retrieved for mounting a further closure device;

the closure device may comprise the features of the two preceding paragraphs combined; in such a case, the closure device forms a joining interface between said receptacle and said dispensing head, thus simplifying the assembly and disassembly, in particular of a refill on the dispensing head and on the receptacle;

the closure device may comprise the features of the four preceding paragraphs combined; thus, there is a common interface for the dispensing head, the container and the receptacle; this simplifies the assembly of a corresponding dispensing device, in particular in the context of refills;

said first mounting interface is reversible; thus, it is possible to recover the dispensing head in order to mount another closure device thereon;

said first mounting interface is irreversible; thus, it is impossible to recover the dispensing head, which then becomes an integral part of a refill that cannot be separated by the user; on the other hand, another element mounted to the closure device in a reversible manner can be recovered; on the other hand, this makes it possible to carry out the filling by a subcontractor, to send a refill with the container sealed by the closure device to a dispensing device manufacturer, who will be able to simply assemble the dispensing head to the refill in an irreversible manner, in particular by making it possible only to recover another element mounted on the refill, such as a receptacle surrounding the container, in particular, a receptacle such as mentioned in this application;

the one or more reversible mounting interfaces are manual mounting interfaces and thus allow manual disassembly; by manual is meant without tools; this allows easy mounting and disassembly by the user on the closure device;

the one or more reversible mounting interfaces are reversible threads or clips; these are mounting systems easy to implement for a user;

the closure wall comprises a fixing interface, in particular an irreversible one, intended to be fixed to the neck of a container of a liquid to pasty product and arranged on one side of a first surface of the closure wall and around a zone where the communication conduit opens onto this first surface; this makes it possible to fix a container filled with product and thus to form a refill;

according to the preceding paragraph, the closure device can also comprises the reversible mounting interface intended to be mounted on the neck of a receptacle, mentioned above, this mounting interface being arranged around the fixing interface; the receptacle thus forms a protective shell of the container as well as a gripping means; moreover, this shell can be more easily arranged in an aesthetic manner;

the closure wall comprises a cone flaring out from the opening of the communication conduit on a first surface of the closure wall, the bottom as well as said lateral opening(s) of the closure being housed in this cone and at a distance from the walls of this cone when the closure is in the open position; this makes it possible to channel the flow of product around the closure, in particular towards its lateral opening(s);

the closure device comprises only two assembled one-piece parts, namely the stopper and the closure base, the latter comprising the closure wall and forming the remainder of the closure device; the closure device is thus very simple to make; in particular when it is equipped therewith, the closure base comprises the mounting interface(s) and the fixing interface.

Another object of the invention is a refill of a liquid to pasty product to be mounted on a dispensing head and comprising:

a container of a liquid to pasty product, having a neck with a container opening, a closure device according to the invention, mounted on the neck of the container in such a way that, when the stopper is in the closed position, said closure wall closes said container opening in a sealed manner.

This refill is of simple design. The closure device ensures that it is closed and ready for use as soon as it is assembled.

When the various mounting interface options are present, the use of this refill is greatly simplified.

The refill according to the invention may optionally have one or more of the following features taken separately or in combination:

- the container is a flexible pouch; this is a simple form of construction, particularly useful in the case of a refill;
- the refill comprises a protective cage fixed to the closure device, the container being housed inside said cage; this facilitates the insertion of the refill container into a receptacle, in particular a recoverable one;
- the neck of the container comprises an annular rim around the opening of the container and projecting radially, the cage comprising an insertion inlet for the container, the edges of the insertion inlet clamping the annular rim against the closure wall, thus ensuring the seal between the latter and the container; the seal is achieved without any additional parts
- the refill comprises only four assembled parts: the closure base, the stopper, the pouch and the cage.

It should be noted that the refill according to the invention can be used to refill a product dispensing device, as a replacement for an exhausted refill, or as an initial assembly to a dispensing head. The assembly to the latter may be reversible or irreversible, in the latter case a recoverable receptacle being mounted around the container.

Another object of the invention is a device for dispensing, in particular without air intake, a liquid to pasty product comprising:

- a refill according to the invention, the container being mounted on the side of a first surface of the closure wall,
- a dispensing head mounted on the other side of the closure wall and fluidly connected to the communication conduit, the closure being in the open position.

This makes the dispensing device ready to be used or assembled to a receptacle, as mentioned above.

If the dispensing head is mounted in a reversible way, it can be kept, the refill being changed when there is no more product.

Furthermore, the design and assembly of the refill with the dispensing head is simple.

When the various mounting interface options are present, this mounting is further simplified.

The dispensing device according to the invention may optionally have one or more of the following features taken separately or in combination:

- the dispensing head comprises:
  - a tube inserted into said communication conduit, with a sealed contact between the external wall of the tube and the internal wall of the communication conduit, the tube bearing axially against a thrust surface of said stopper and in the direction of the opening of this stopper, the tube having a first opening in fluid communication with said cavity and the lateral opening(s),
  - an orifice for dispensing the product from the dispensing device in fluid communication with a second opening of the tube;

this tube makes it possible, when the refill is mounted, to push the stopper into its open position; thus, by simply mounting the dispensing head with the refill, the stopper is opened and the dispensing head and the said container are placed in product communication;

- the first opening of the tube is at one end of the tube, the edges of this first opening resting against the edges of said cavity, which thus form the pushing surface; said communication in synergy with the opening is improved;
- the dispensing head comprises a head base, the tube projecting from an external surface of this head base and towards the stopper, the tube having a length substantially equal to the distance between said closed position and said open position; this allows closing of said communication conduit with the head base;
- the dispensing device comprises a receptacle mounted, in particular reversibly, on the closure base on the refill side, the refill being arranged inside the receptacle; this receptacle can be recovered when the refill is exhausted;
- the receptacle comprises at least one portion through which the container can be seen, the latter being deformable and/or at least translucent, so that its filling state can be seen;
- the receptacle is made of glass;
- the receptacle is made of polymer.

In the present application, the terms "up", "down", "lower", "upper", "top", "bottom", refer, unless otherwise indicated, to the orientation of the horizontally positioned closure wall, the surface intended to face the product oriented downwards, which corresponds, in the examples illustrated by the annexed drawings, to the orientations according to FIGS. 5 and 6.

Further features and advantages of the invention will become apparent from the detailed description of the following non-limiting examples, for the understanding of which reference is made to the attached drawings, among which:

FIG. 7 shows the dispensing device of FIG. 6 in a side perspective view, but without the protective cap.

Figure 1:
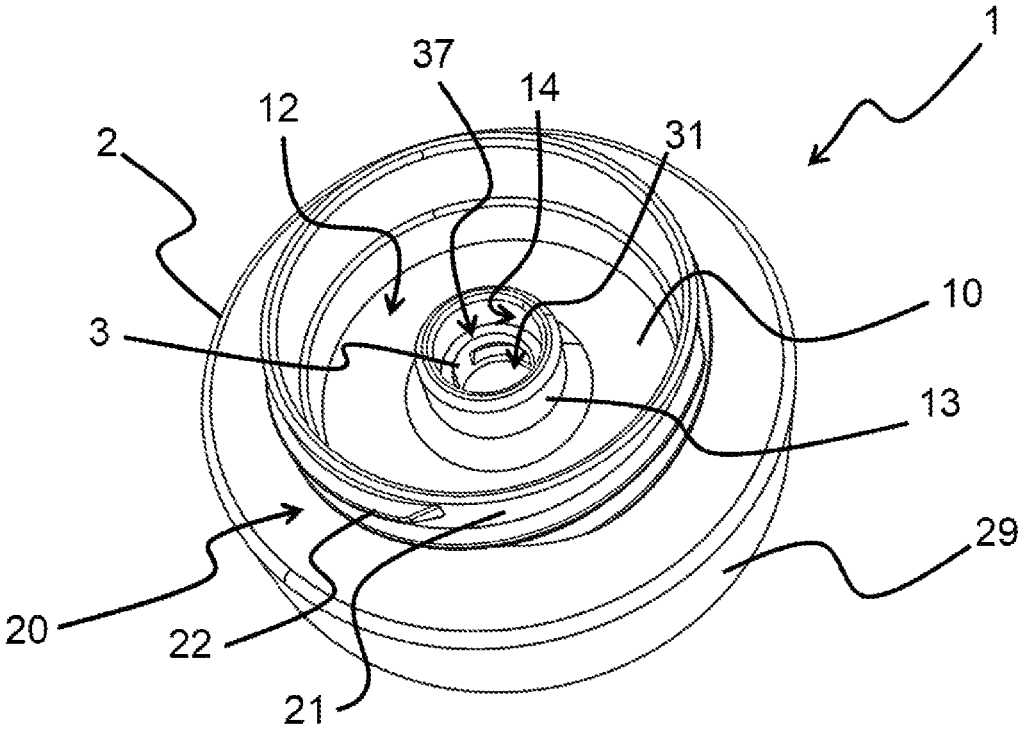
FIG. 1 is a top perspective view of a closure device according to an example embodiment of the invention.
Figure 2:
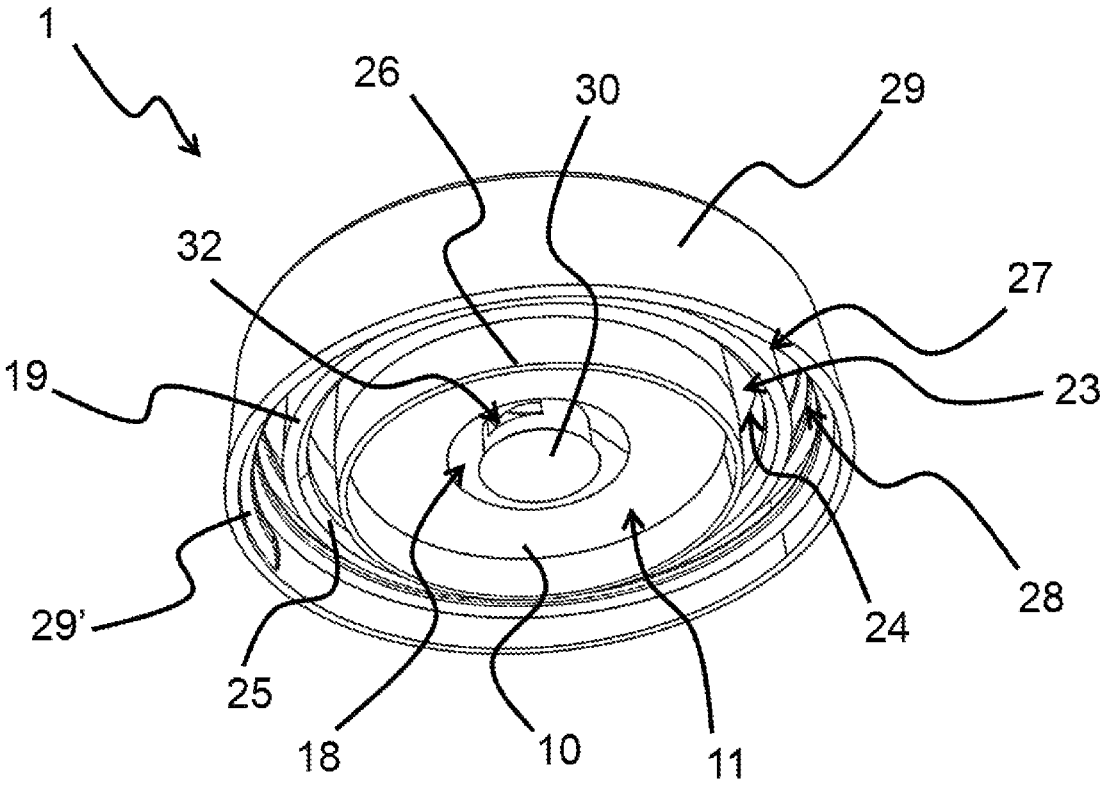
FIG. 2 shows a perspective view from below of the closure device of FIG. 1.

FIGS. 1 and 2 illustrate a closure device 1 according to an embodiment of the invention. This closure device 1 is intended to close a container of a liquid to pasty product, for example a cream or ointment.

This closure device 1 comprises a closure base 2 and a stopper 3. As here, the closure base 2 and the stopper 3 may each be a one-piece part. In this example, the closure device 1 consists of a closure base 2 and a stopper 3.

The closure base 2 comprises a closure wall 10, here forming a horizontal bottom wall of the closure base 2.

A communication conduit 13 passes through the closure wall 10 from side to side, thus ensuring communication on both sides of this closure wall 10. Thus, the communication conduit 13 comprises two openings between which it extends: a communication opening 16*a*, here low, located on the side of a first surface 11 of the closure wall 10, and a communication opening 16*b*, here high, located on the other side, namely a second surface 12 of the closure wall 10, here located on top.

The stopper 3 is arranged with the communication conduit 13 movably between a closed position and an open position. In FIGS. 1 and 2, it is shown in the open position.

Figure 3:
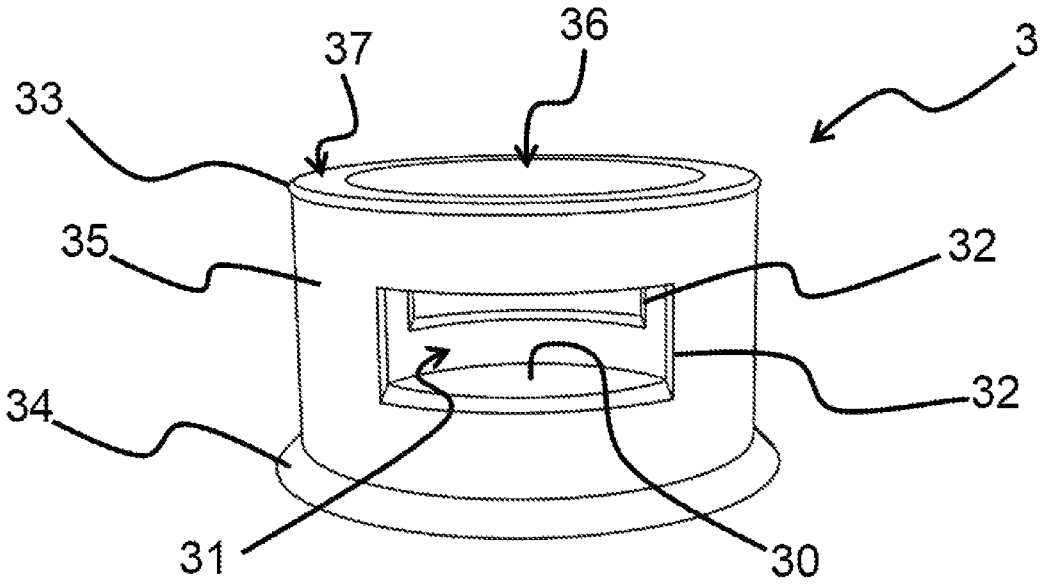
FIG. 3 shows a side perspective view of the stopper of the closure device of FIG. 1.

The stopper 3 is illustrated in more detail in FIG. 3.

As in this example, the stopper 3 may form a cup having a cavity 31 open at the top, thus open on the side of the second surface 12 of the closure wall 10 via a main opening 36. The cavity 31 is closed at the bottom by a bottom 30 and delimited at the sides by a cylindrical wall 35. The cavity 31 has, in this case, two lateral openings 32 opposite each other.

The stopper 3 may as here have a deformable member 33. The latter is, for example, a peripheral bead 33 arranged in a protruding manner on the outer surface of said cylindrical wall 35, thus forming a friction member for retaining the stopper 3 in the communication conduit 13, thus engaging the inner wall 14 of the communication conduit 13.

In this example, the deformable member 33 has two functions: both to give a certain resistance to opening to the stopper 3, when it is in the closed position, and to form a member for blocking the stopper 3 in the open position.

Said deformable member 33 may be arranged at the very top of the cylindrical wall 35, thus allowing the stopper 3 to descend as far as possible, leaving the greater part of the stopper outside the communication conduit 13, in particular, as here, so as to completely exit the lateral openings 32 of the communication conduit 13.

As here, the peripheral bead 33 can go around the cylindrical wall 35, thus also providing a sealing function with the inner wall 14 of the communication conduit 13.

Here, the internal wall 14 of the communication conduit 13 is smooth. Alternatively, not shown, it could have an upper annular groove and/or a lower annular groove, arranged to receive the peripheral bead 33, the upper annular groove allowing locking in the closed position and the lower annular groove allowing locking in the open position.

According to the invention, as here, the stopper may have a lower projection 34, extending around the cylindrical wall 35 and radially outwards. It is arranged so as to come into contact with the edge of the lower communication opening 16*a* of the communication conduit 13, when the stopper is in the closed position. Thus, this projection 34 on the one hand reinforces the sealing of the closure of the communication conduit 13 and, on the other hand, forms an end stop in the closed position.

As here, the closure wall 10 may comprise a cone 17 flaring from the lower communication opening 16*a*.

In the open position, the bottom 30 and side openings 32 are clear down and out of the communication conduit 13 but are housed within this cone 17, as can be seen in FIG. 2. Thus, the bottom 30 and side openings 32 are spaced from the walls of this cone 17, thus leaving a passage under the closure wall 10 from a bottom opening 18 of the cone, then through the side openings 32, then into the cavity 31 and finally to said main opening 36.

The projection 34 may be complementary in shape to said first surface 11, thereby enhancing the seal in the closed position. For example, as shown here, it may be frustoconical so as to be fitted with the cone 17 in the closed position.

The closure base 2 comprises on the side of said second surface 12 a first mounting interface 20, here reversible, which comprises an upper skirt 21 extending upwards and having an external surface provided with a reversible mounting element, here a thread 22. The upper skirt 21 is arranged around the communication conduit 13 and its upper communication opening 16*b*, thus around an area where the communication conduit 13 opens onto this second surface 12.

On the other side of the closure wall 10, namely on said first surface 11, the closure base 2 comprises two further interfaces:

- an irreversible mounting interface 23 arranged around the cone 17 and the lower communication opening 16*a*,
- a second reversible mounting interface 27 arranged around the fixing interface.

According to the invention, as herein, the second mounting interface 27 may comprise a mounting groove 28, defined between a lower skirt 29 and a first shaft 19. The inner surface of the lower skirt 29 may, as herein, comprise a thread 29'.

According to the invention, as herein, the fixing interface 23 may comprise an attachment groove 24, defined between the first shank 19 and a second shank 26. The surface of the first shank 19 within the attachment groove 24 may, as herein, comprise an annular bead 25, here forming an irreversible clip.

As here, the lower skirt 29, the first shaft 19 and the second shaft 26 may be arranged concentrically and in that order from the outside towards the lower communication opening 16*a*.

The closure base 2 may, for example, be made of polypropylene and the closure of high density polyethylene (HDPE).

Figure 4:
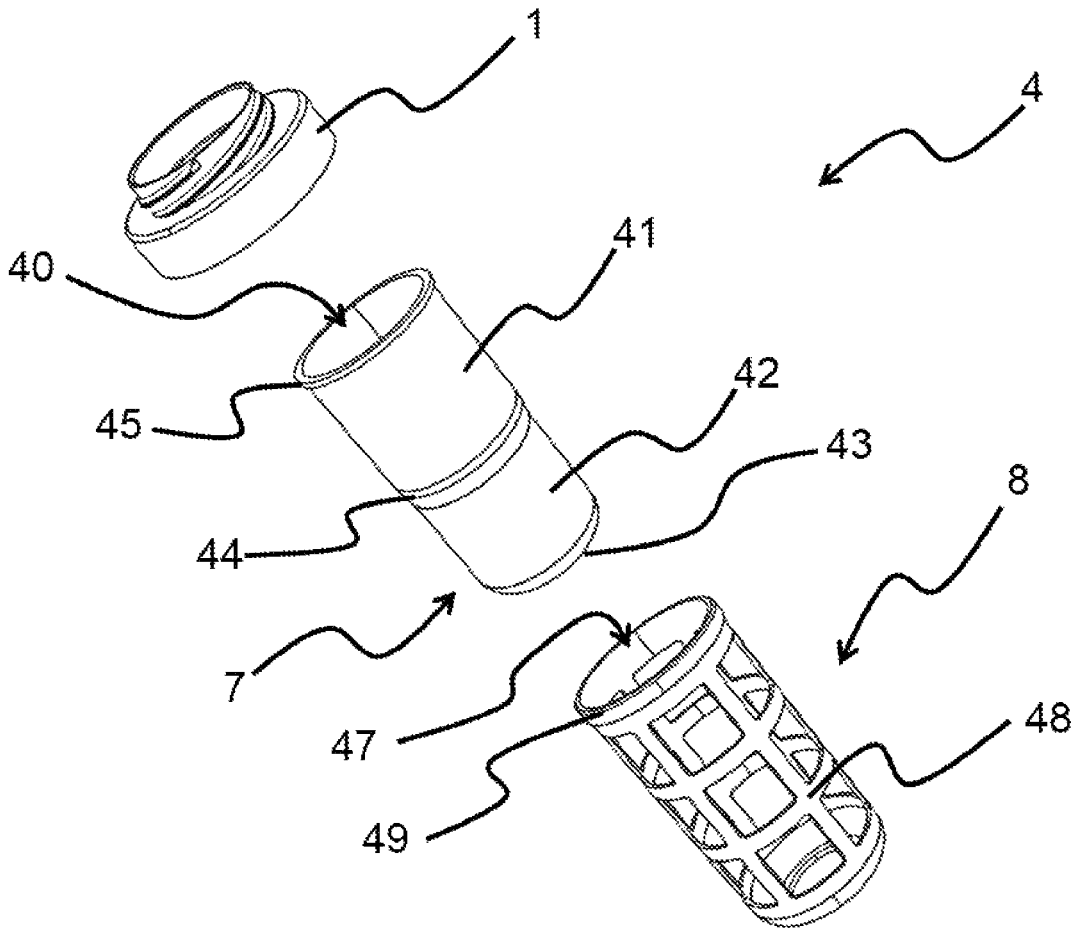
FIG. 4 shows an exploded view of a refill according to an example of an embodiment of the invention, comprising the closure device of FIG. 1.
Figure 5:
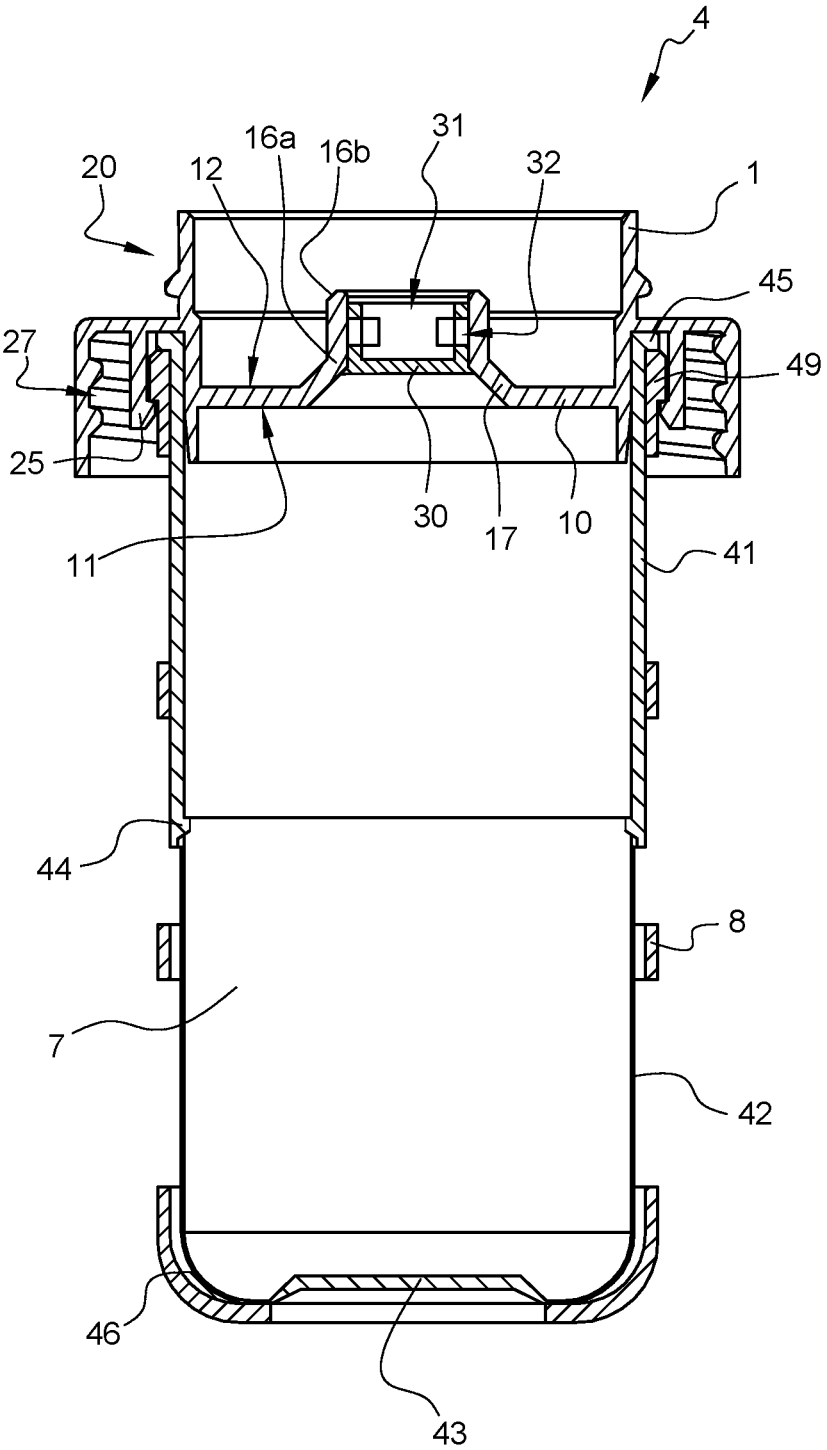
FIG. 5 shows an axial section of the refill of FIG. 4, before mounting in a dispensing device.

FIGS. 4 and 5 illustrate an example of a refill 4 of a liquid to pasty product according to the invention.

This refill 4 comprises:

- a container of a liquid to pasty product, here a pouch 7,
- the closure device 1 mounted on the neck of the pouch 7.

As can be seen in FIG. 5, before use, the stopper 3 is in the closed position and seals the communication conduit 13. Indeed, the bottom 30 closes the communication conduit 13. As a result, once the closure device 1 is mounted on the container neck, the closure wall 10 seals the container opening 40. The refill 4 is thus a refill suitable for a dispensing device without air intake, also called "airless" type.

The lateral openings in the cup-shaped embodiment of the stopper 3 are above the bottom 30, for example, as here, within the communication conduit 13.

The projection 34 is here fitted against the inner surface of the cone 17.

The deformation of the deformable member 33 is such that the stopper 3 is maintained in the closed position, up to a certain threshold of thrust exerted on the stopper 3 towards the open position. The closure of the refill 4 is thus secured.

The pouch 7 can, as here, be broken down into four areas formed by:

- a rigid upper side wall 41,
- a flexible, deformable lower side wall 42, continuous downwards with said upper side wall 41, in particular with an internal diameter close to or identical to that of said upper side wall 41
- a first articulation 44 between said upper side wall 41 and said lower side wall 42
- a rigid bottom wall 43 having a diameter smaller than the internal diameter of said side walls 41, 42,
- a second articulation 46 between said lower side wall 42 and the bottom wall 43.

Figure 6:
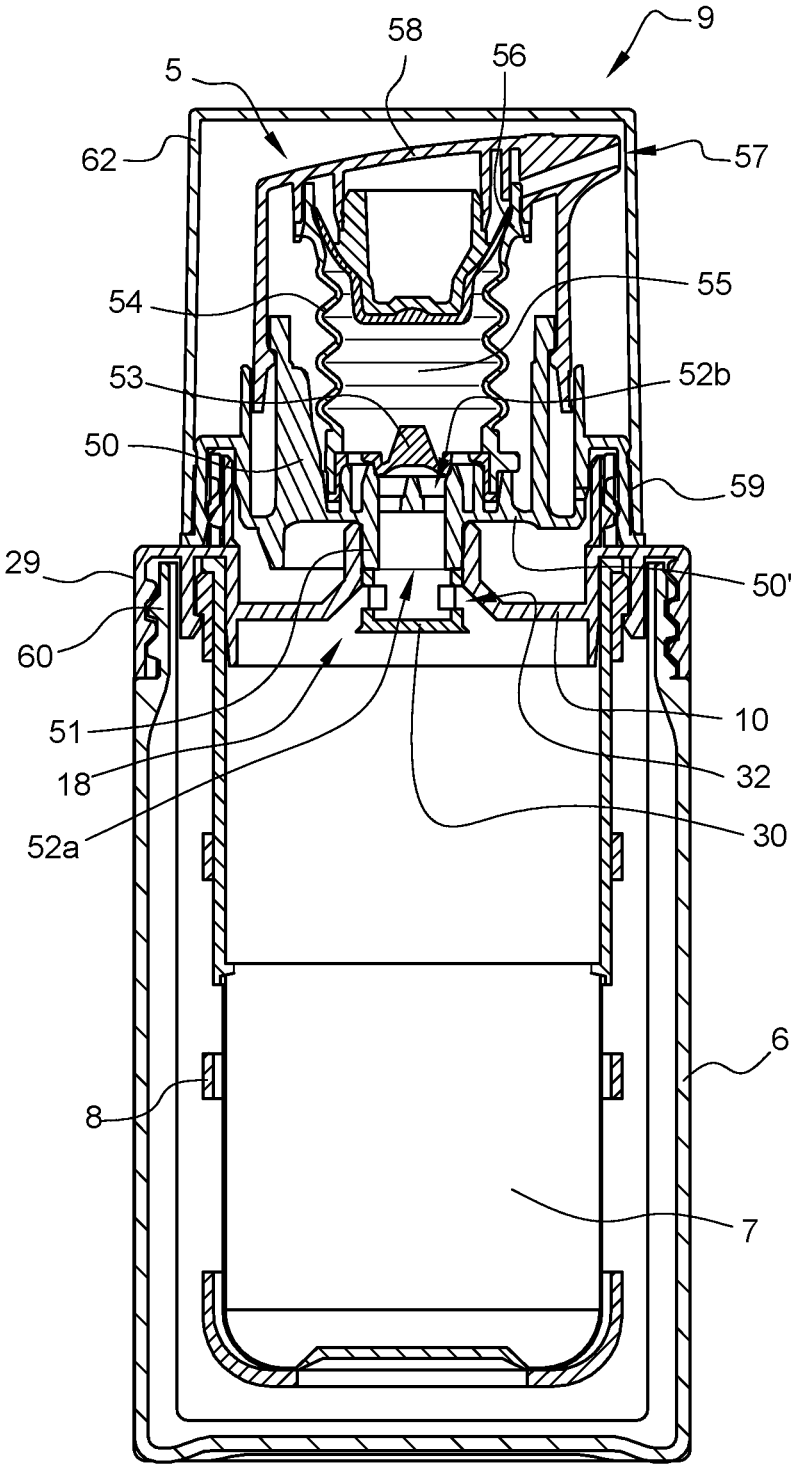
FIG. 6 represents a cross-sectional view according to the same plane as FIG. 5 of a dispensing device according to an example of an embodiment of the invention, comprising the refill of FIG. 5.

Once mounted in a dispensing device, such as that of FIG. 6, in such a pouch 7, when subjected to a vacuum, when dispensing the product, the bottom wall 43 is driven towards the opening 40 of the pouch 7, with the second hinge 46, driving the second hinge 46 and said bottom side wall 42 in turning on themselves. Thus, the bottom wall rises inside the pouch 7 towards the opening 40 of the pouch 7, in the manner of a piston to expel the contained product.

In particular, this pouch 7 functions as described in WO2013153297A1.

The neck of the pouch 7 comprises a free peripheral end, which may as here comprise an annular rim 45 delimiting the opening 40 of the pouch 7 and projecting radially outwardly from said upper lateral portion 41.

As herein, the refill 4 may comprise a protective cage 8 attached to the closure device 1. The pouch 7 is housed within the cage 8.

The cage 8 includes an insertion inlet 47 for the pouch 7 into the cage 8. The insertion inlet 47 is surrounded by an edge forming an outer annular shoulder 49. The cage 8 allows the pouch 7 to be protected, in particular from the flexible lower lateral portion 42, when the refill 4 is dispensed or transported separately from the dispensing device. However, its wall forms a cylindrical grid 48, making it possible to visualize the amplitude of the overturning, and thus the emptying, of the pouch 7.

According to the invention, as here, this cage 8 may also serve as a sealing element for clamping the pouch 7 against the closure wall 10.

For example, as here, the necks of the pouch 7 and the cage 8 are forcefully inserted into the attachment groove 24. The annular rim 45 is seated against the top of said shoulder 49, and the latter is clipped into the attachment groove 24 after passing the annular bead 25. After attachment, the annular rim 45 is clamped between the closure wall 10 and said shoulder 49, the latter itself being clamped by the annular bead 25 towards the closure wall, thus ensuring a seal between the closure wall 10 and the interior of the pouch 7.

FIGS. 6 and 7 illustrate a dispensing device 9 for a liquid to pasty product according to an embodiment of the invention.

This dispensing device 9 comprises:

the refill 4, a dispensing head 5 mounted on the side of said second surface 12 and fluidly connected to the communication conduit 13, the stopper 3 being in the open position.

Here, the dispensing head 5, hereinafter head 5, comprises a head base 50 having an outer bottom surface 50', facing the closure wall 10. The head base 50 also comprises a tube 51, which protrudes from this lower surface 50' and downwards and extends between a first opening 52*a*, here at the bottom, and a second opening 52*b*, here at the top.

The tube 51 is inserted into said communication conduit 13 in sealing contact between the outer wall of the tube 51 and the inner wall 14 of the communication conduit 13.

Here, the tube 51 has a length substantially equal to the distance between the upper free edge of the stopper 3, in the open position, and the edge of the upper communication opening 16*b*, as can be seen in FIG. 6. This distance also corresponds to the distance between the closed position and the open position of the stopper 3.

Thus, when the head 5 is mounted on the closure base 2, here by screwing, the tube 51 comes opposite the stopper 3, is inserted into the communication conduit 13 on the side of said second surface 12, then descends into this conduit, the edges of the first opening 52*a* of the tube 51 coming to bear against the edges of the cavity 31, which thus form a thrust surface 37. Indeed, when the head 5 is screwed on, the tube 51 exerts a downward thrust on this thrust surface 37, until it exceeds said thrust threshold. The stopper 3 is then driven downwards, as the tube 51 descends into the conduit 13, until the head base 50 abuts the edge of the upper communication opening 16*b*. In addition to a stop, this also provides an additional sealing area between the communication conduit 13 and the head 5.

Thus, once the head 5 is mounted, the tube 51 is axially supported against said thrust surface 37 and in the direction of the opening of the stopper 3. Furthermore, the first opening 52*a* of the tube 51 is in fluid communication with said cavity 31. Moreover, with the stopper in the open position, the lateral openings 32 and said bottom 30 are outside the communication conduit 13. Fluid communication between the refill 4, more particularly the interior of the pouch 7 and the head 5 is thus established through the stopper 3.

In this example, the head 5 comprises in a known manner:

a pusher 58 slidably mounted on the head base 50, a bellows 54 connected at the top to the pusher 58 and at the bottom to the head base 50 and delimiting a metering chamber 55, a low non-return valve 53 closing an inlet of the chamber 55, this inlet being here directly in fluid communication with the second opening 52*b* of the tube 51, a high non-return valve 56 closing an outlet of the chamber 55 and communicating with a dispensing orifice 57 for the product outside the dispensing device 9.

Thus, when the plunger 58 is pushed down, the bellows 54 is compressed causing a pressure on the fluid contained in the dosing chamber 55 (i.e. on air before priming or on product after priming), which causes the lower valve 53 to close and the upper valve 56 to open and the fluid to be expelled out of the chamber 55, then out of the dispensing orifice 57.

After this thrust, the plunger 58 is pushed upwards by the bellows 54 causing a depression in the chamber 55, the closing of the upper valve 56 and the opening of the lower valve 53. The fluid is then sucked into the chamber 55.

Here, the fluid is channeled into the cone 17, through the side openings 32, into the cavity 31, and then through the main opening 36 in the tube 51, to the chamber inlet 55, and fills the chamber 55.

As an alternative, not shown, other types of dispensing head can be considered, such as piston systems.

In this example, the head 5 comprises a head skirt 59 with an internal thread screwed to said top skirt 21.

The dispensing device 9 may also comprise a receptacle 6, the neck 60 of which is here screwed into the mounting groove 28.

The pouch 7 and the cage 8 are thus housed in the receptacle 6, which forms the outer shell of this dispensing device 9. This shell may, in particular, include various inscriptions on its outer surface.

Thus, when the dispensing device 9 has exhausted the product to be dispensed, it is possible to unscrew the head 5 and the receptacle 6, to throw away the empty refill, while keeping the head 5 and the receptacle 6.

Then, the head 5 is reused by screwing it onto a new refill 4, of which it has been ensured that the stopper 3 was in the upper position. Then, the cage 8 and the pouch 7 of the refill 4 are inserted into the receptacle 6 and the outer skirt 29 of the closure device 1 is screwed onto the neck of the receptacle 6. A refilled dispensing device 9 is thus obtained, ready for use.

According to the invention, as in the example shown in FIG. 7, the receptacle 6 may include a window 61 extending longitudinally across the receptacle 6 from a height less than or equal to that of the bottom of the cage 8, to a height greater than or equal to that of the first hinge 44.

Thus, in this example, this window 61 forms an example of a portion 61 through which the pouch 7 can be seen, and in particular check whether its lower lateral part 42 is turned, in particular substantially completely, inside its upper lateral part 41, so that its filling state can be seen.

Note that in FIG. 6, the head 5 comprises a cap 62 covering the plunger.

The receptacle 6 with its window 61 may for example be made of polypropylene (PP).

In an alternative embodiment not shown, instead of a window, the receptacle may be made of a transparent or translucent material, such as glass or polyethylene terephthalate (PETG).

The dispensing device 9 is particularly economical since only the refill 4 is changed; the head 5 and the receptacle 6 are reusable.

Furthermore, according to the invention, at least the refill 4 can be made of recyclable materials.

Furthermore, here, the refill 4 is very simple in design, particularly in only three pieces. It is also simple to assemble and disassemble to the head 5 and the receptacle 6, particularly in this example where only screwing/unscrewing operations are performed by the end user.

According to a variant not shown, the first mounting interface 20 may be made to be irreversible, in particular via one or more irreversible clips instead of a thread, in particular via an annular clip. In some applications, it may indeed be interesting to change only the receptacle 6. This also allows a completion of the filling of the pouch 7 before sealing it by the closure device 1 in the closed position, and then transporting this refill to the assembly site of the dispensing device, while leaving a witness of integrity of the refill.

The invention claimed is:

1. A stopper device for a container of a liquid to pasty product, said stopper device comprising:

a stopper base comprising a stopper wall having a through communication conduit, said stopper wall being intended to close the opening of a container of a liquid to pasty product, a stopper movable in the communication conduit between a closed position and an open position, wherein the stopper comprises a bottom and a cavity open on one side of the stopper wall and closed by said bottom, the cavity comprising at least one lateral opening, the stopper being arranged with the communication conduit so that:

in the closed position, said bottom sealingly closes the communication conduit, and in the open position, the stopper is partially out of the communication conduit, said at least one lateral opening and said bottom being out of the communication conduit, so that the communication conduit is open in fluid communication through the stopper, the stopper comprising a thrust surface on the edges of the said cavity capable of receiving in axial abutment the edges of a first opening of a tube belonging to a dispensing device in the direction of opening of the stopper, wherein the stopper wall comprises a cone flaring out from an opening of the communication conduit on a first surface of the stopper wall, the bottom as well as said at least one lateral opening of the stopper being housed in this cone and at a distance from walls of this cone when the stopper is in the open position.

2. The stopper device according to claim 1, wherein the communication conduit communicates between the first surface and a second surface of the stopper wall, said stopper wall being intended to close the opening of the container of a liquid to pasty product with the first surface facing the interior of the container, so that in the closed position, said side opening(s) and said bottom are in the communication conduit and in the open position, said side opening(s) and said bottom are out of the communication conduit by being on the side of said first surface.

3. The stopper device according to claim 1, wherein the communication conduit and/or the stopper comprise at least one deformable member, arranged to retain the stopper in the closed position up to a certain threshold of thrust exerted on the stopper towards the open position.

4. The stopper device according to claim 3, wherein said deformable member and/or said blocking member are arranged on and/or engage the inner wall of the communication conduit.

5. The stopper device according to claim 1, wherein the communication conduit and/or the stopper comprise a member for blocking the stopper in the open position.

6. The stopper device according to claim 1, in which the stopper wall has a first surface and a second surface opposite this first surface, and comprises an irreversible fixing interface which is:

intended to be fixed to the neck of a container of a liquid to pasty product, arranged on the side of said first surface, and arranged around a zone where the communication conduit opens onto this said first surface.

7. The stopper device according to claim 6, wherein said irreversible fixing interface comprises at least one irreversible clip.

8. The stopper device according to claim 7, wherein said first mounting interface is reversible.

9. The stopper device according to claim 6, wherein the stopper base comprises a first reversible or irreversible mounting interface which is:

intended to be mounted on a dispensing head, arranged on the side of said second surface, and arranged around a zone where the communication conduit opens onto this second surface.

10. The stopper device according to claim 9, wherein the stopper base comprises a second reversible mounting interface which is intended to be mounted on the neck of a receptacle, arranged on the side of said first surface, and arranged around the mounting interface.

11. The stopper device according to claim 9, wherein the one or more mounting interfaces are manual mounting interfaces and thus allow manual removal.

12. A refill of a liquid to pasty product to be mounted on a dispensing head and comprising:

a container of a liquid to pasty product, having a neck with a container opening, a stopper device according to claim 1, mounted on the neck of the container in such a way that, when the stopper is in the closed position, the said stopper wall closes the said container opening in a sealed manner.

13. The refill according to claim 12, wherein the container is a flexible pouch.

14. The refill according to claim 12, comprising a protective cage attached to the stopper device, the container being housed within said cage.

15. The refill according to claim 14, wherein the container neck comprises an annular rim around the container opening and projecting radially, the cage comprising an insertion inlet for the container, the edge of the insertion inlet engaging the annular rim against the stopper wall, thereby providing a seal between the latter and the container.

16. A dispensing device for a liquid to pasty product comprising:

a refill according to claim 13, the container being mounted on the side of a first surface of the stopper wall, a dispensing head mounted on the other side of the stopper wall and fluidly connected to the communication conduit, the stopper being in an open position, wherein the dispensing head comprises:

a tube inserted in said communication conduit, with a tight contact between the external wall of the tube and the internal wall of the communication conduit, the tube being axially supported against the thrust surface of said stopper and in the direction of opening of this stopper, the tube having a first opening in fluid communication with the said cavity and the at least one lateral opening, a dispensing orifice for the product outside the dispensing device in fluid communication with a second opening in the tube, wherein the first opening of the tube is at one end of the tube, the edges of this first opening resting against the edges of said cavity, which thus form the pushing surface.

17. The dispensing device according to claim 16, wherein the dispensing head comprises a head base, the tube projecting from an outer surface of this head base and towards the stopper, the tube having a length substantially equal to the distance between said closed position and said open position.

18. The dispensing device according to claim 16, comprising a receptacle reversibly mounted on the stopper base on the side of the refill, the refill being arranged inside the receptacle, the receptacle comprising at least one portion through which the container can be seen, the latter being deformable and/or at least translucent, so that its state of filling can be seen.

19. The dispensing device according to claim 18, wherein the receptacle is made of glass.

20. The dispensing device according to claim 18, wherein the receptacle is made of polymer.

* * * * *